310-13 333 SR
4/29/86 XR 4,585,397

United States Patent [19]
Crawford et al.

[11] Patent Number: 4,585,397
[45] Date of Patent: Apr. 29, 1986

[54] DUAL BELLOWS PUMP WITH DRIVE CIRCUIT THROUGH BELLOWS

[75] Inventors: Roy P. Crawford, Saratoga; Robert B. Watrous, San Jose, both of Calif.

[73] Assignee: International Business Machines Corporation, Armonk, N.Y.

[21] Appl. No.: 740,925

[22] Filed: Jun. 3, 1985

[51] Int. Cl.[4] ..... F04B 21/00; F04B 43/00; H02K 33/00

[52] U.S. Cl. ..... 417/63; 417/412; 310/13; 310/27

[58] Field of Search ..... 417/412, 413, 63, 422; 310/13, 27

[56] References Cited

U.S. PATENT DOCUMENTS

| | | | |
|---|---|---|---|
| 1,941,642 | 1/1934 | Vincent | 417/412 |
| 2,061,869 | 11/1936 | Gilbert et al. | 417/412 |
| 3,143,969 | 8/1964 | Eames et al. | 417/63 X |
| 3,781,140 | 12/1973 | Gladden | 310/27 X |
| 4,421,464 | 12/1983 | Schmidt et al. | 310/27 X |
| 4,468,170 | 8/1984 | Hanset | 417/63 X |

FOREIGN PATENT DOCUMENTS

| | | | |
|---|---|---|---|
| 1310663 | 10/1962 | France | 310/27 |

*Primary Examiner*—Carlton R. Croyle
*Assistant Examiner*—Theodore W. Olds
*Attorney, Agent, or Firm*—Thomas R. Berthold

[57] ABSTRACT

A pump includes a pair of circular metal bellows rigidly secured to the pump housing at the perimeter of their accordion-like ring structures and interconnected at their centers so as to be capable of flexing in phase. An electrical coil is attached to the interconnected bellows and is axially movable with the bellows. The coil is surrounded by a permanent magnet structure secured to the pump housing. Each bellows communicates with an associated fluid chamber which has a valve structure for the inlet and outlet of fluid. The coil is electrically connected to an alternating current power supply, the connection being made through the electrically conductive bellows. The bellows flex in phase in the presence of the alternating current to the coil and thus alternately pull fluid in and force fluid out of the respective fluid chambers. Since the fluid chambers are connected to a common fluid output and since the bellows axially flex in phase, there are two pressure pulses per pump cycle.

16 Claims, 4 Drawing Figures

DUAL BELLOWS PUMP WITH DRIVE CIRCUIT THROUGH BELLOWS

TECHNICAL FIELD

This invention relates to pumps, and in particular to pumps in which the fluid is displaced by the reciprocating action of a bellows.

BACKGROUND OF THE INVENTION

Conventional bellows-type pumps utilize a reciprocating flexure element, such as a metal bellows, which draws fluid into and forces fluid out of a chamber during each cycle of the bellows action. The bellows is typically connected to a solenoid actuator drive or a reciprocating rotary drive mechanism.

Examples of solenoid-actuated bellows-type pumps are described in U.S. Pat. No. 2,797,646 to Pomykata and U.S. Pat. No. 2,849,159 to Kaufmann. A rotary drive bellows-type pump is described in U.S. Pat. No. 2,419,775 to Hazard.

U.S. Pat. No. 2,257,862 to Sarver describes a bellows-type pump having two bellows, each bellows being connected to an electromagnetic actuator. The two bellows surround a common fluid chamber and flex out of phase to alternately expand and contract the chamber.

U.S. Pat. No. 4,365,942 to Schmidt describes a liquid helium bellows-type pump which utilizes two fixed electrical coils near the end walls of a fluid chamber and a third electrical coil attached to a movable piston located within the fluid chamber. The piston is attached to a bellows at each of its ends. The interaction of the electromagnetic fields among the three coils causes the third coil and the attached piston to oscillate within the chamber to generate the pumping action of the bellows.

All of the conventional bellows-type pumps utilize drive mechanisms which require either sliding or rolling frictional contact among various parts. Pumps of such design thus require various types of bearings in order to function properly. In addition, lubrication may be required to produce reasonable pump life.

SUMMARY OF THE INVENTION

The present invention is a positive-displacement bellows-type pump with interconnected double bellows driven by a voice coil motor (VCM) and having no moving parts in frictional contact. The pump is designed primarily as an air pump but functions equally as well as a pump for various types of gaseous fluids.

Two circular metal bellows are rigidly secured at their perimeters to a surrounding housing and interconnected at their centers by a connecting shaft. Each bellows defines a fluid chamber and is connected to an electrical coil which is positioned in a fixed permanent magnetic field. As alternating current is supplied to the coils, an alternating axial force is generated which causes the connected bellows to flex linearly in phase such that one bellows is at an exhaust stroke when the other bellows is at an inlet stroke. The two bellows, which are rigidly secured to the housing, support the interconnected shaft and the coils so that there are no moving parts in frictional contact. The current is supplied to the coils through the electrically conductive bellows, thus eliminating the need for a flexible cable to the VCM.

The pump also includes a failure detection system in the form of a current sensor and an electrical contact between the bellows and the supporting housing. In the event either of the bellows or any of the valves fails, the pump armature moves from its central operating zone and electrical contact is made with the normally isolated housing. A simple sense circuit detects the presence of drive voltage on the housing. The failure of either of the coils is also detected by current sensing in the drive circuit.

For a fuller understanding of the nature and advantages of the present invention, reference should be made to the following detailed description taken in conjunction with the accompanying drawings.

DESCRIPTION OF THE PREFERRED EMBODIMENTS

Figure 1:
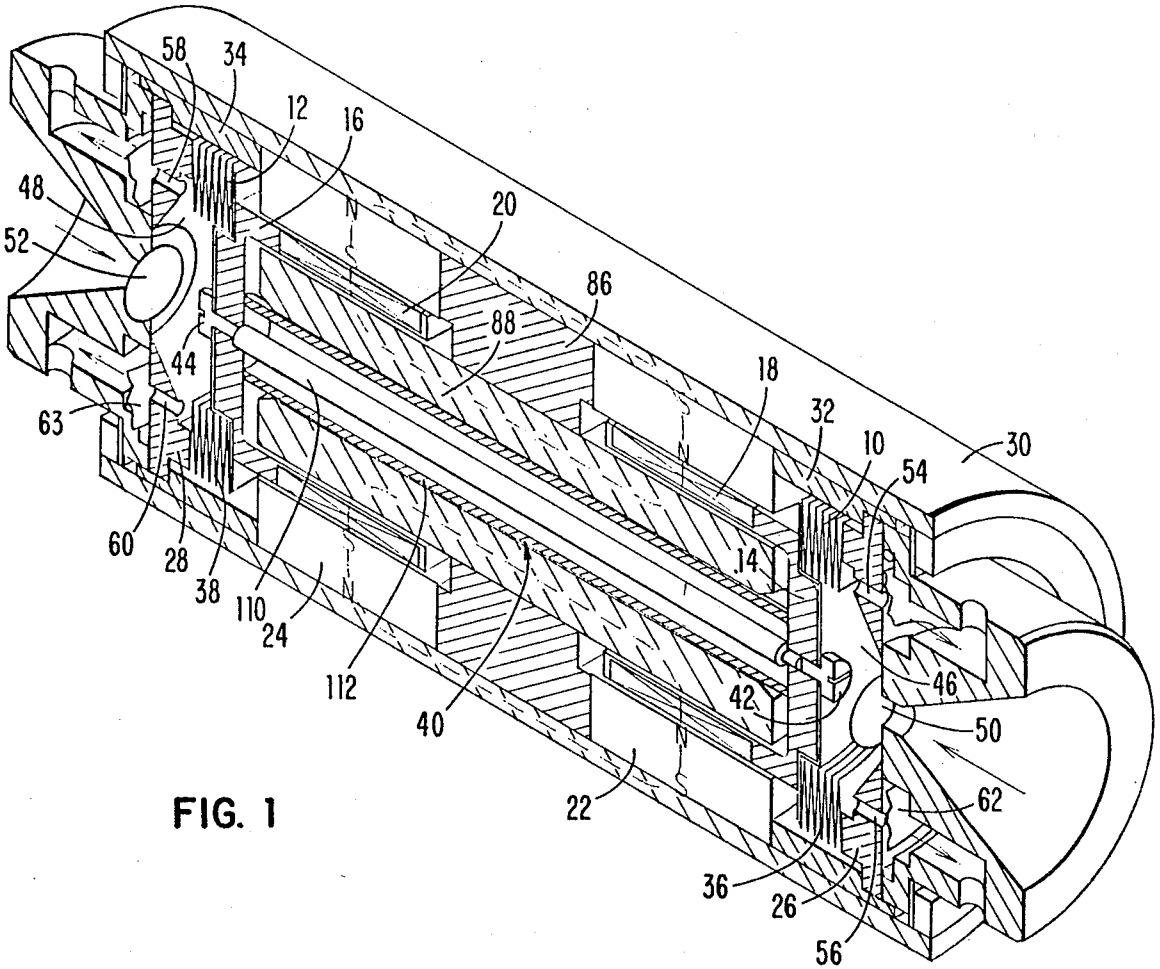
FIG. 1 is a perspective cut-away view of the pump with the coils electrically connected in parallel.

Referring first to FIG. 1 it should be noted that the generally cylindrically shaped pump is symmetrical about the sectional plane. The flexure elements which serve to pump the fluid are metal bellows 10, 12 which have a generally circular shape and are oriented generally perpendicular to the longitudinal axis of the cylindrically shaped pump. The bellows 10, 12 are connected to coil supports 14, 16 which have flat portions attached to the centers of the bellows and generally annular portions which extend axially toward the center of the pump. The coil supports 14, 16 serve to support multiturn electrical coils 18, 20 which are wrapped around the coil supports. Located radially outwardly from the coils 18, 20 but not in contact with the coils are permanent magnets 22, 24, each of which generates a magnetic field oriented generally perpendicularly to the current path in a respective one of the coils 18, 20. Each of the magnets 22, 24, as shown in FIG. 1, extends around and is concentric with its respective coil.

Each of the bellows 10, 12 is attached to a respective end plate 26, 28. Relative to the bellows, the end plates 26, 28 are located axially away from the center of the cylindrical pump and are supported by and are electrically isolated from the outer pump housing 30. As shown in FIG. 1 the end plates 26, 28 are centered with respect to housing 30 by means of intermediate insulator rings 32, 34. Each of the end plates 26, 28 is attached to its respective bellows 10, 12 by welding at the outside diameter of the top plate of the bellows assembly. With this construction of the bellows 10, 12, end plates 26, 28, insulator rings 32, 34 and housing 30, the metal bellows 10, 12 are generally rigidly secured relative to one another and are thus able to move only by flexure in the axial direction. This is because the bellows 10, 12 are interconnected along their axial direction of flexure by means of a center shaft 40 which essentially rigidly secures the centers of the circular bellows 10, 12, as shown in FIG. 1. The center shaft 40, in the embodiment of FIG. 1, further comprises a central portion 110 and a radially outer portion 112. This connection is made by means of bolts 42, 44, each of which passes through an opening in the center of the respective bellows and coil support and into a threaded bore in a respective end of portion 110 of center shaft 40.

The end plates 26, 28, together with their respective bellows 10, 12, define fluid chambers, generally identified as 46, 48, near the axial ends of the pump. The end plates 26, 28 have central openings 50, 52 for fluid inlet into the respective chambers 46, 48 and a plurality of openings, such as openings 54, 56 on end plate 26 and openings 58, 60 on end plate 28, which provide a fluid outlet from the respective fluid chambers.

Figure 2A:
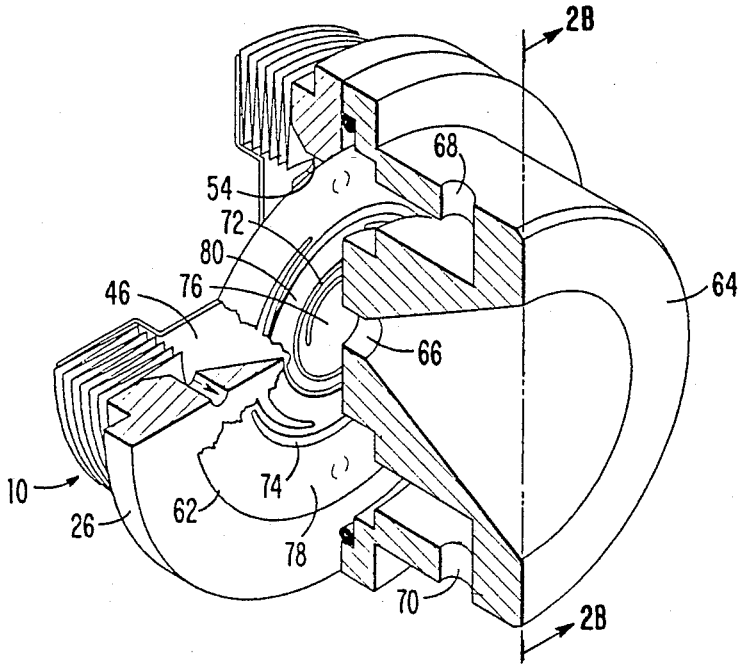
FIG. 2A is a perspective cut-away view showing one of the bellows, valve and manifold assemblies of the pump.
Figure 2B:
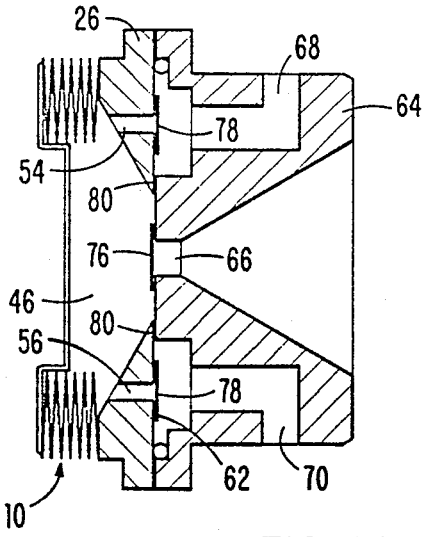
FIG. 2B is a view of section 2B—2B of FIG. 2A.

Referring now to FIGS. 2A and 2B, the construction of the end plates 26, 28 and the means for directing fluid into and out of the respective fluid chambers 46, 48 can be better understood. There is shown in FIGS. 2A and 2B the metal bellows 10, end plate 26, valve structure 62 and manifold 64. The manifold 64 provides paths for the flow of fluid into and out of the fluid chamber 46. The manifold 64 has a central inlet port 66 and outlet ports 68, 70. The outlet ports 68, 70 are connected to various conduits (not shown) which deliver the fluid to its destination.

Located between the end plate 26 and manifold 64 is the valve structure 62 which allows the fluid to pass between the manifold 64 and the fluid chamber 46. Valve structure 62 is generally circularly shaped and has a first group of cutouts in the form of helical shaped slots 72 at a first radial location and a second group of cutouts in the form of helical shaped slots 74 at a second and radially outer location. The slots 72, 74 permit the center segment 76 and annular outer segment 78 of the valve structure 72 to be generally flexible when the middle annular segment 80, between the two groups of circular slots 72, 74, is generally rigidly secured between end plate 26 and manifold 64. Thus when the segment 80 of valve structure 62 is secured between end plate 26 and manifold 64, as shown in FIGS. 2A and 2B, the center segment 76 located over inlet port 66 serves as the inlet valve since it is capable of flexing relative to segment 80 because of the first group of slots 72. Similarly the outer annular segment 78 located over openings 54, 56 of end plate 26 serves as the outlet valve and is capable of flexing relative to segment 80 because of the second group of slots 74.

Referring again to FIG. 1, the magnet structure of the pump comprises the two magnets 22, 24, an annular non-magnetic spacer 86 between the two magnets 22, 24, a magnetically permeable tube 88 radially located between the center shaft 40 and magnets 22, 24 and the magnetically permeable housing 30. The tube 88 is attached to the spacer 86, but is not in contact with shaft 40, magnets 22, 24 or coils 18, 20. The magnets 22, 24 are of opposite polarity, as shown by the polarity markings on FIG. 1. Each of the magnets 22, 24 comprises four magnet segments, each segment being of generally quarter-circular configuration and radially spaced about its respective coil. Only two of the segments of each magnet 22, 24 are shown in FIG. 1 because of the sectional view. With the magnet structure as shown and described, a magnetic circuit is generated as indicated by the dotted lines in FIG. 1. The magnetic circuit includes tube 88 and housing 30, both of which are magnetically permeable. The portion of the magnetic circuit through the coils 18, 20 comprises a magnetic field which is generally perpendicular to the direction of the electrical wire which is formed into the turns of the coils.

Figure 3:
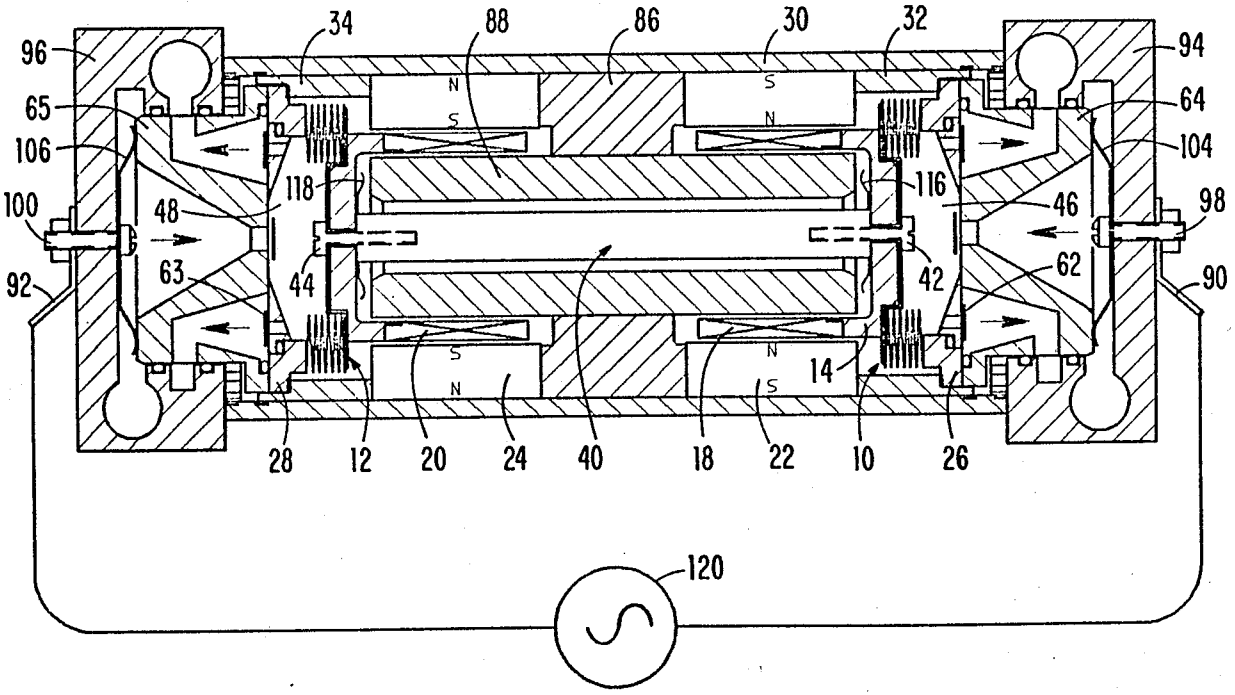
FIG. 3 is a plan sectional view of the pump with the coils electrically connected in series.

Referring now to FIG. 3, the pump is electrically connected to an alternating current (A/C) power supply 120. The electrical connection to coils 18, 20 is made to terminals 90, 92 on respective housing end caps 94, 96 which are secured over respective manifolds 64, 65. Bolts 98, 100 pass through terminals 90, 92 and connect to conductive spring clips 104, 106 which provide contact between the manifolds 64, 65 and housing ends 94, 96, respectively. The electrical conduction path within the pump is made through terminal 90, bolt 98, spring clip 104, manifold 64, end plate 26, metal bellows 10, and coil 18. The electrical path from coil 18 to the other coil 20 will be described with reference first to the series connection embodiment of the pump shown in FIG. 3. One of the leads 17 of coil 18 passes along the outside surface of coil support 14 and into contact with metal bellows 10. The other lead 19 from coil 18 passes along the inside surface of coil support 14 and into contact with the electrically conductive connecting shaft 40. At the other end of the pump the shaft 40 is in electrical contact with the leads 21, 23 of coil 20 in the same manner as described for coil 18. Similarly, the other lead of coil 20 is in contact with metal bellows 12. The conduction path out of the pump is through end plate 28, manifold 65, spring clip 106, bolt 100, and terminal 92.

The coils 18, 20 through which the alternating electrical current passes move in the presence of the fixed magnetic fields 22, 24, thereby forming a VCM. Unlike conventional VCMs which require a flexible ribbon type electrical cable because the coil itself moves, the VCM of the present pump has electrical connection made directly from the metal bellows and other pump components. The electrical connection just described, and as shown in FIG. 3, has the two coils 18, 20 of the VCM connected in series. Each of the coils 18, 20 is wound about the coil supports such that the direction of current flow through the coils is in opposite directions. Each of the coils is associated with a magnetic field which has a polarity opposite to that of the magnetic field associated with the other coil.

The embodiment of the pump illustrated in FIG. 1 is identical to the embodiment of FIG. 3 with the exception that in the alternative embodiment of FIG. 1 the coils are electrically connected in parallel by means of two separate shaft portions which comprise the connecting shaft 40, namely radially inner central portion 110, and concentric radially outer portion 112. It should also be noted that for ease of illustration FIG. 1 does not show housing end caps 94, 96 or the means for external electrical connection as described for the embodiment of FIG. 3. In the embodiment of FIG. 1, electrical connection to the input leads 31, 33 of coils 18, 20 is made through shaft portion 110 and connection to the output leads 35, 37 of coils 18, 20 is made through shaft portion 112. Shaft portion 110 is electrically connected to bellows 10 through bolt 42 and shaft portion 112 is electrically connected to bellows 12. Bolt 44 is electrically insulated from bellows 12.

As shown in FIG. 3, the pump also includes means for detecting the failure of either of the bellows or any of the valves. This failure means comprises electrical contacts 116, 118 attached to respective coil supports 26, 28 and located between the movable coil supports and the fixed tube 88, which forms part of the magnetic circuit. These electrical contacts 116, 118 are connected to the pump's electrical circuit previously described.

It should be apparent that while the preferred embodiment of the pump has been described with two separate coil and magnet arrangements, i.e. as a dual VCM, the present invention will also function with a single coil and associated magnet structure. Moreover, there are numerous arrangements of the fixed permanent magnet and associated movable coil which can be incorporated into the pump to create a linear oscillation of the connected bellows in phase.

The above-described pump can be better understood by considering the function of the components during operation. When the series-connected pump of FIG. 3 is connected to the AC power supply 120, current is directed to the two coils 18, 20 through the electrical conductive path as described previously. Because the magnets 22, 24 are generally concentric with the coils, at any point around the coil the direction of current flow and the direction of the respective magnetic field are mutually perpendicular. Thus the cross product of the current vector and the magnetic field vector generates a force which is in the axial direction, i.e. parallel to connecting shaft 40. Since the coils are wired such that current flows through them in opposite directions and since the coils are in the presence of magnetic fields of opposite polarity, the force applied to both coils at any instant in time is in the same direction. Thus in the presence of an alternating current, the two coils, and accordingly the two metal bellows to which they are attached, oscillate axially in phase. During oscillation the movement of the two bellows creates pressure differentials across the valve structures 62, 63 of the respective fluid chambers 46, 48. For example, if the connected bellows are at the intake stroke for bellows 10, the pressure differential will move valve segment 76 (FIG. 2B) away from manifold 64 and pull air into chamber 46. During the exhaust stroke of bellows 10 the pressure differential will force valve segment 76 against manifold 64 (thereby closing the inlet port 66) and valve segment 78 away from end plate 26 (thereby opening outlet ports 68, 70). While one bellows is at its exhaust stroke, the other bellows is at its intake stroke. There are thus two pressure pulses of fluid per cycle of the pump. The outlet ports of each manifold 64, 65 are connected externally to provide a common fluid output.

It should be noted that the pump has no rolling or sliding members in frictional contact with one another and thus no bearings or lubrication are required. The entire movable portion of the pump is supported by the metal bellows themselves, namely the portions of the bellows attached to the end plates 26, 28, which in turn are rigidly located with respect to the pump housing 30 by insulating spacers, 32 and 34.

In the event there is a structural failure in either of the bellows or the valve assemblies, then the connected bellows will be driven beyond its design stroke to one end or the other. This results in one of the electrical contacts 116, 118, providing an intermittent electrically conductive path from the A/C power supply, through the magnetically permeable tube 88, spacer 86 and housing 30. This voltage can be sensed by a suitable sensing means to determine that there has been a failure within the pump.

While the preferred embodiments of the present invention have been illustrated in detail, it should be apparent that modifications and adaptations of those embodiments will occur to those skilled in the art without departing from the scope of the present invention as set forth in the following claims.

What is claimed is:

1. A pump comprising:

a pair of flexure elements, at least one of the flexure elements being electrically conductive;

means for supporting the flexure elements in spaced-apart relationship with their directions of flexure being generally collinear;

means for rigidly connecting the flexure elements together generally along their directions of flexure, whereby the spaced-apart flexure elements are capable of flexing in phase;

an electrically conductive coil secured to and electrically coupled with said at least one flexure element and movable therewith during flexure;

means located proximate the coil for generating a magnetic field generally perpendicular to the conductive paths in the coil;

a pair of end plates attached to respective flexure elements and defining fluid chambers therewith, the end plate attached to said at least one flexure element being electrically conductive and electrically coupled with said at least one flexure element, each end plate being rigidly secured to the supporting means for the flexure elements and thereby immovable during flexure; and means for allowing the entry and exit of fluid into and out of each fluid chamber, whereby when an alternating current is supplied through said at least one end plate and attached flexure element to the coil, the coil and connected flexure elements flex in alternating directions in phase with the current and fluid is alternately drawn into and forced out of the fluid chambers.

2. The pump according to claim 1 wherein both end plates, both flexure elements and the flexure element connecting means are electrically conductive, wherein the coil comprises two separate coils, each coil being attached to and electrically coupled with a respective flexure element, and wherein the means for generating a magnetic field further comprises two separate magnetic field generating means, each magnetic field generating means being associated with and in proximity to a respective separate coil.

3. The pump according to claim 2 wherein the coils are electrically connected in series.

4. The pump according to claim 2 wherein the flexure element connecting means includes two separate electrically conductive paths and wherein the coils are electrically connected in parallel.

5. The pump according to claim 2 further comprising means for sensing the failure of any one of the flexure elements or fluid entry and exit means.

6. The pump according to claim 1 wherein each flexure element further comprises a bellows.

7. The pump according to claim 1 wherein each end plate includes a fluid inlet and a fluid outlet and wherein the fluid entry and exit allowing means further comprises flexibly movable valves located over the fluid inlet and outlet of each end plate.

8. The pump according to claim 7 further comprising a pair of fluid manifolds, each manifold being attached to a respective end plate and providing an inlet path to the fluid inlet of the end plate and an outlet path from the fluid outlet of the end plate.

9. A pump comprising:

a pair of electrically conductive circular bellows;

an electrically conductive shaft rigidly connecting and electrically coupling the bellows generally at their centers;

a pair of electrically conductive coils, each coil being secured to and electrically coupled with a corresponding bellows and having a generally annular shape surrounding and extending radially from the connecting shaft;

a magnet structure generally concentric with the coils, the magnet structure being oriented to generate a magnetic field generally perpendicular to the direction of current flow in the coils;

a pair of electrically conductive end plates, each end plate being attached to and electrically coupled with a corresponding bellows for defining a fluid chamber therewith and having openings providing passages into and out of the corresponding fluid chamber;

a pair of value structures, each value structure being located over the openings on a corresponding end plate;

a housing surrounding the connected bellows for supporting the magnet structure and end plates in fixed relationship, whereby the connected bellows and associated coils are axially movable relative to the fixed magnet structure and end plates; and a pair of manifolds located at the ends of the housing, each manifold providing an inlet path for the fluid past a corresponding valve structure into the corresponding fluid chamber and an outlet path for the fluid past the corresponding valve structure out of the corresponding fluid chamber when the connected bellows oscillate axially in response to an alternating current supplied to the coils through the electrically coupled end plates, bellows, and connecting shaft.

10. The pump according to claim 9 wherein the manifolds are electrically conductive and electrically coupled with the respective end plates, and further comprising means on each of the manifolds for providing electrical connection to an alternating current supply, whereby current is supplied to an end plate through a respective manifold.

11. The pump according to claim 9 wherein the coils are electrically connected in series.

12. The pump according to claim 9 wherein the connecting shaft includes two separate electrically conductive paths and wherein electrical connection from the bellows to the coils is such that the coils are electrically connected in parallel.

13. The pump according to claim 9 wherein the coils are wound in opposite directions and wherein the magnet structure generates a magnetic field through one of the coils which is of opposite radial direction to the magnetic field through the other coil.

14. The pump according to claim 9 further comprising means for sensing the failure of any one of the bellows or valve structures, the sensing means further comprising an electrical contact between each of the bellows and the magnet structure and determining means connected to the housing for determining when either of said bellows is in electrical contact with the magnet structure.

15. The pump according to claim 9 wherein the magnet structure further comprises a first group of permanent magnet segments mated to form an annular magnet generally concentric with and radially spaced from one of the coils, a like second group of magnet segments for the other coil, the first and second magnet groups for the two coils being oriented to generate magnetic fields of opposite polarity, and magnetically permeable material located generally parallel to the connecting shaft and radially between the connecting shaft and the coils for providing a magnetic circuit between the first and second magnet groups.

16. The pump according to claim 9 wherein each valve structure further comprises a thin disk having a first group of cutouts at a first radial location and a second group of cutouts at a second radial location, whereby when the generally annular segment of the thin disk between the two groups of cutouts is rigidly secured, the remaining portions of the disk are flexibly movable as valves.

* * * * *